US009004319B2

(12) United States Patent
Kim

(10) Patent No.: US 9,004,319 B2
(45) Date of Patent: Apr. 14, 2015

(54) FOAMING PUMP

(71) Applicant: Tae Hyeon Kim, Changwon-si (KR)

(72) Inventor: Tae Hyeon Kim, Changwon-si (KR)

(73) Assignee: Tae Hyeon Kim, Gyeongsangnam-do (KR)

( * ) Notice: Subject to any disclaimer, the term of this patent is extended or adjusted under 35 U.S.C. 154(b) by 101 days.

(21) Appl. No.: 13/849,950

(22) Filed: Mar. 25, 2013

(65) Prior Publication Data

US 2014/0097209 A1 Apr. 10, 2014

(30) Foreign Application Priority Data

Oct. 9, 2012 (KR) ..... 10-2012-0112110

(51) Int. Cl.
*B67D 7/76* (2010.01)
*B05B 7/00* (2006.01)
*B05B 11/00* (2006.01)

(52) U.S. Cl.
CPC ..... *B05B 7/0037* (2013.01); *B05B 11/3087* (2013.01)

(58) Field of Classification Search
CPC B05B 11/3087; B05B 7/0031; B05B 7/0037; B05B 7/0043; B05B 7/0056; B05B 7/0062; B05B 7/0068; A47K 5/14
USPC ..... 222/190, 135, 137, 321.1, 321.4, 222/321.7–321.9, 340
See application file for complete search history.

(56) References Cited

U.S. PATENT DOCUMENTS

| | | | | |
|---|---|---|---|---|
| 6,053,364 | A * | 4/2000 | van der Heijden | 222/145.6 |
| 6,840,408 | B1 * | 1/2005 | Foster et al. | 222/190 |
| 8,006,869 | B2 * | 8/2011 | Iizuka | 222/190 |
| 8,079,497 | B2 * | 12/2011 | Brouwer | 222/153.13 |
| 8,292,127 | B2 * | 10/2012 | van der Heijden | 222/190 |
| 8,336,737 | B2 * | 12/2012 | van der Heijden | 222/145.3 |
| 8,376,190 | B2 * | 2/2013 | Choi et al. | 222/190 |
| 8,496,142 | B2 * | 7/2013 | Uehira et al. | 222/190 |
| 8,622,252 | B2 * | 1/2014 | Kerr et al. | 222/190 |
| 2008/0093386 | A1 * | 4/2008 | Arminak | 222/190 |
| 2011/0272432 | A1 * | 11/2011 | Baughman | 222/136 |
| 2012/0104048 | A1 * | 5/2012 | Tseng | 222/190 |
| 2012/0234866 | A1 * | 9/2012 | Lin | 222/190 |
| 2013/0221553 | A1 * | 8/2013 | Chen | 264/8 |

* cited by examiner

*Primary Examiner* — Kevin P Shaver
*Assistant Examiner* — Nicholas J Weiss
(74) *Attorney, Agent, or Firm* — Saliwanchik, Lloyd & Eisenschenk

(57) ABSTRACT

Disclosed is a foaming pump. The foaming pump includes a cylinder which receives contents discharged from a container and air introduced from outside, an open/close unit which opens or closes the cylinder, a head unit which is movable up or down and operates the open/close unit, and a cover unit coupled to the cylinder and the head unit to allow the head unit to move up or down therein. Thus, it is possible to generate and provide soft and minutely uniform foam.

6 Claims, 9 Drawing Sheets

FOAMING PUMP

CROSS-REFERENCE TO RELATED APPLICATION

This application claims the benefit under 35 U.S.C. §119 of Korean Patent Application No. 10-2012-0112110, filed Oct. 9, 2012, which is hereby incorporated by reference in its entirety.

BACKGROUND

1. Field of the Invention

The present invention generally relates to a foaming pump, and more particularly, to a foaming pump used to discharge various kinds of liquid contents such as detergents, cosmetics, and the like such that the liquid contents can be discharged in a predetermined amount through each pumping operation.

2. Description of the Related Art

Generally, a dispenser pump refers to a device which discharges a predetermined amount of gas, liquid or other contents from an airtight container through an outlet each time the pump is pressed. The dispenser pump is applied to various airtight containers for storing cosmetics, perfume, medicine, food, etc.

The related art of the present invention is disclosed in Korean Utility Model No. 20-0436957, registered on Oct. 19, 2007 and entitled "Dispenser capable of sucking discharged contents again."

BRIEF SUMMARY

The present invention is aimed at providing a foaming pump capable of supplying soft and rich foam.

In accordance with one aspect of the present invention, a foaming pump includes a cylinder which receives contents discharged from a container and air introduced from outside; an open/close unit which opens or closes the cylinder; a head unit movable up or down and operating the open/close unit; and a cover unit coupled to the cylinder and the head unit to allow the head unit to move up or down therein.

The cylinder may include a first cylinder receiving air introduced from the outside and a second cylinder receiving the contents discharged from the container, and the open/close unit may include a first open/close portion opening or closing the first cylinder and a second open/close portion opening or closing the second cylinder.

The first open/close portion may include a first shaft inserted into the head unit to form a first air passage between the head unit and the first shaft, and being formed therein with a flow path through which the head unit communicates with the second cylinder, and a first air inlet through which the first air passage communicates with the flow path; and an air piston movable up or down inside the first cylinder and pumping the air from the first cylinder toward the first air passage.

The head unit may include a discharge portion which is formed therein with an outlet communicating with the flow path and is moved downwards by pressing operation to move the first shaft downwards; a head cover placed outside the cover unit to form a second air inlet between the head cover and the cover unit; and a press portion placed inside the cover unit to form a second air passage communicating with the second air inlet between the cover unit and the press portion, coupled to an outside of the first shaft to form the first air passage between the first shaft and the press portion, and moved downwards in association with downward movement of the discharge portion to move the air piston downwards.

The foaming pump may further include: a connecting member placed between the discharge portion and the first shaft and connecting the flow path to the outlet; and a filtering member disposed in the connecting member to cause a mixture of contents and air introduced into the connecting member to be transformed into foam. Here, the filtering member includes: a first filtering member formed with a mesh and provided to one side of the connecting member; a second filtering member formed with a denser mesh than the first filtering member and provided to the other side of the connecting member; and a third filtering member formed with a mesh and provided to the outlet.

The foaming pump may further include an elastic member placed outside the press portion and providing elastic restoration to return the head unit from a pressed state to an original state.

The air piston may include: a press surface forming a top surface of the air piston; and a shaft coupling portion to which the first shaft is internally coupled to form an air entrance through which the first air passage and the second air passage communicate with the first cylinder between the first shaft and the shaft coupling portion.

The open/close unit may further include a support flange supporting the press surface in an upward direction to allow the air piston to move upwards in association with upward movement of the first shaft.

The second open/close portion may include a second shaft formed therein with the flow path; an inlet section placed at a lower side of the second shaft to form an inlet through which the second cylinder communicates with the flow path; and a piston disposed in the second cylinder to selectively open or close the inlet.

The support flange may be placed between the first shaft and the second shaft, and the first shaft, the support flange and the second shaft may be integrated into a single body to be movable up or down.

The foaming pump according to the present invention includes the filtering member, which includes the first filtering member and the second filtering member having a denser mesh than that of the first filtering member, and the third filtering member forming rich foam by generating friction again with foam formed by the first and second filtering members, thereby generating soft, minutely uniform and rich foam.

In addition, the foaming pump according to the present invention provides a blocking structure between the air entrance and the second air passage though engagement between the sealing groove and the sealing projection, and is more effective in introducing air to be mixed with contents therein, thereby generating rich foam through a single operation.

Further, in the foaming pump according to the present invention, the elastic member is placed outside the flow path so as not to contact contents in the pump, and thus can be inhibited from corrosion cause by the contents thereof, or can inhibit the contents from being contaminated.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION

Exemplary embodiments of the present invention will now be described in detail with reference to the accompanying drawings. It should be noted that the drawings are not to precise scale and may be exaggerated in thickness of lines or size of components for descriptive convenience and clarity. Furthermore, the terms used herein are defined by taking functions of the present invention into account and can be changed according to user or operator's custom or intention. Therefore, definition of the terms should be made according to the overall disclosure set forth herein.

Figure 1:
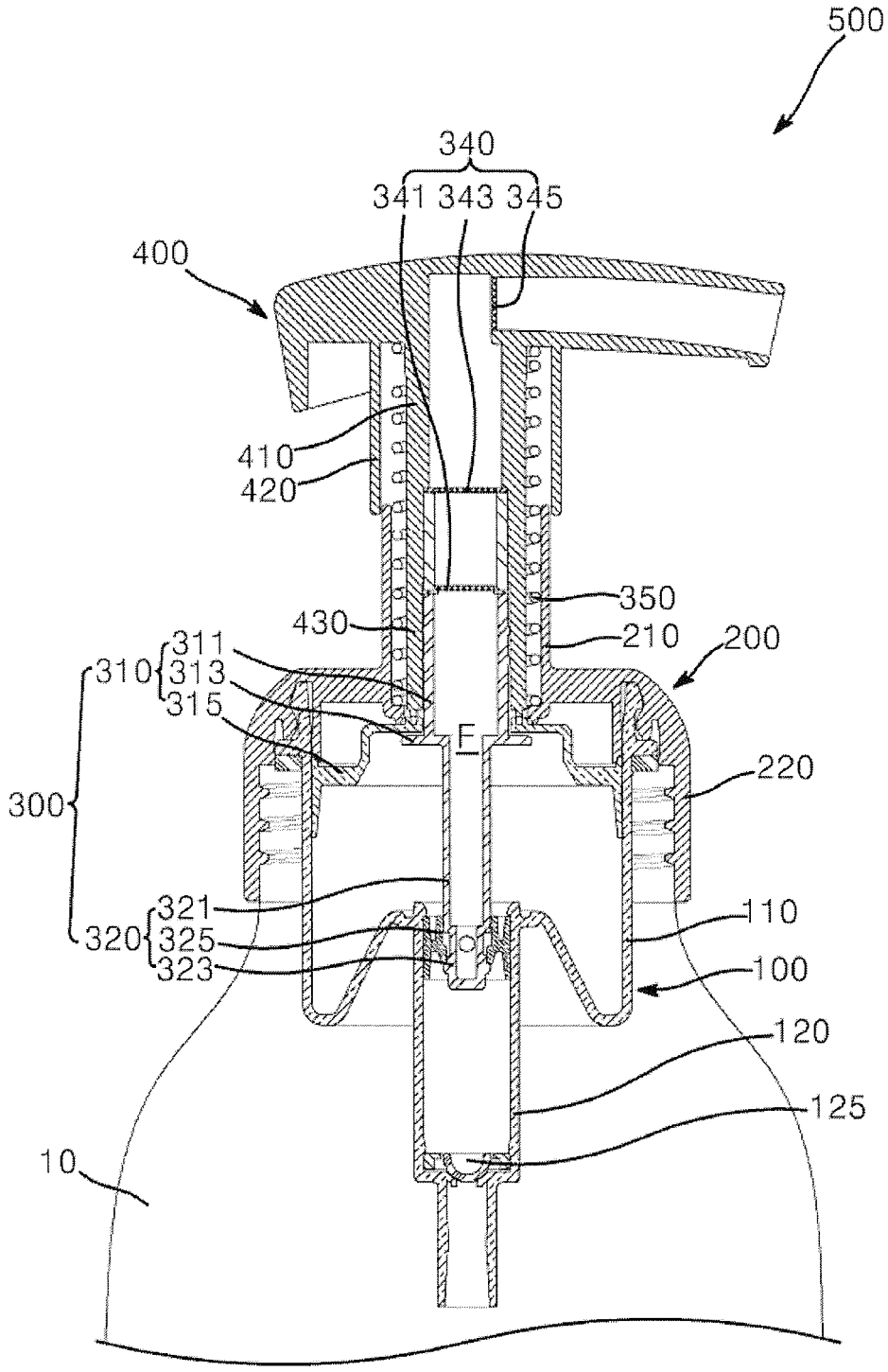
FIG. 1 is a sectional view of a foaming pump according to one embodiment of the present invention.
Figure 2:
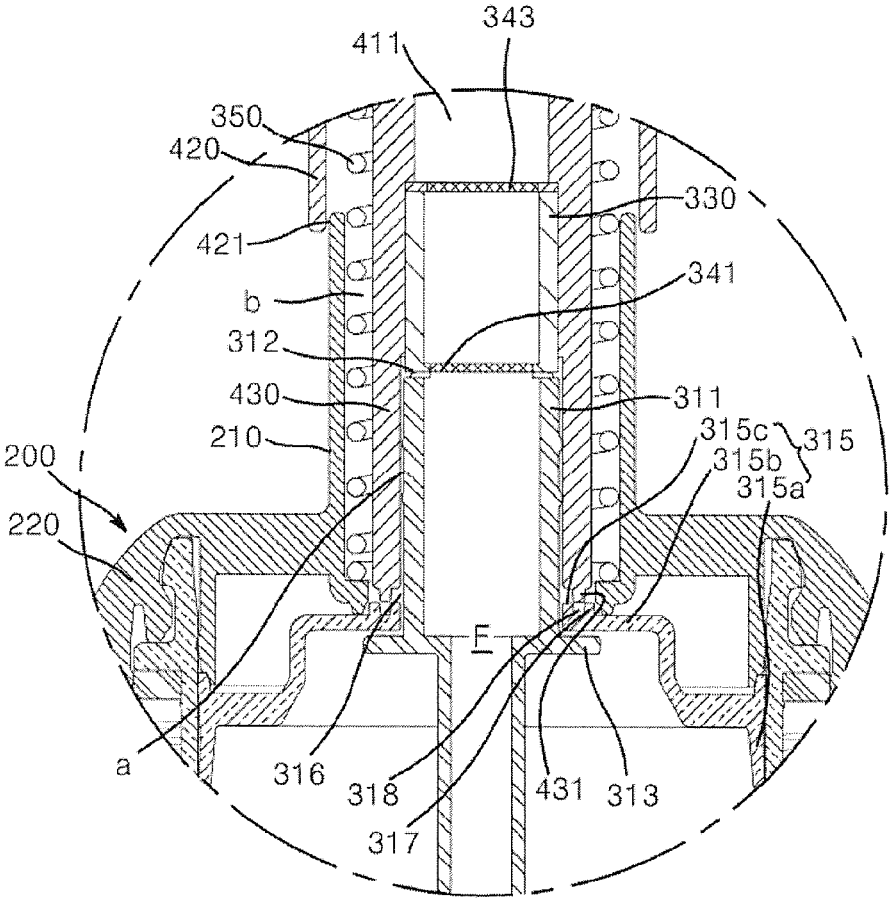
FIG. 2 is an enlarged view of a first open/close portion shown in FIG. 1.
Figure 3:
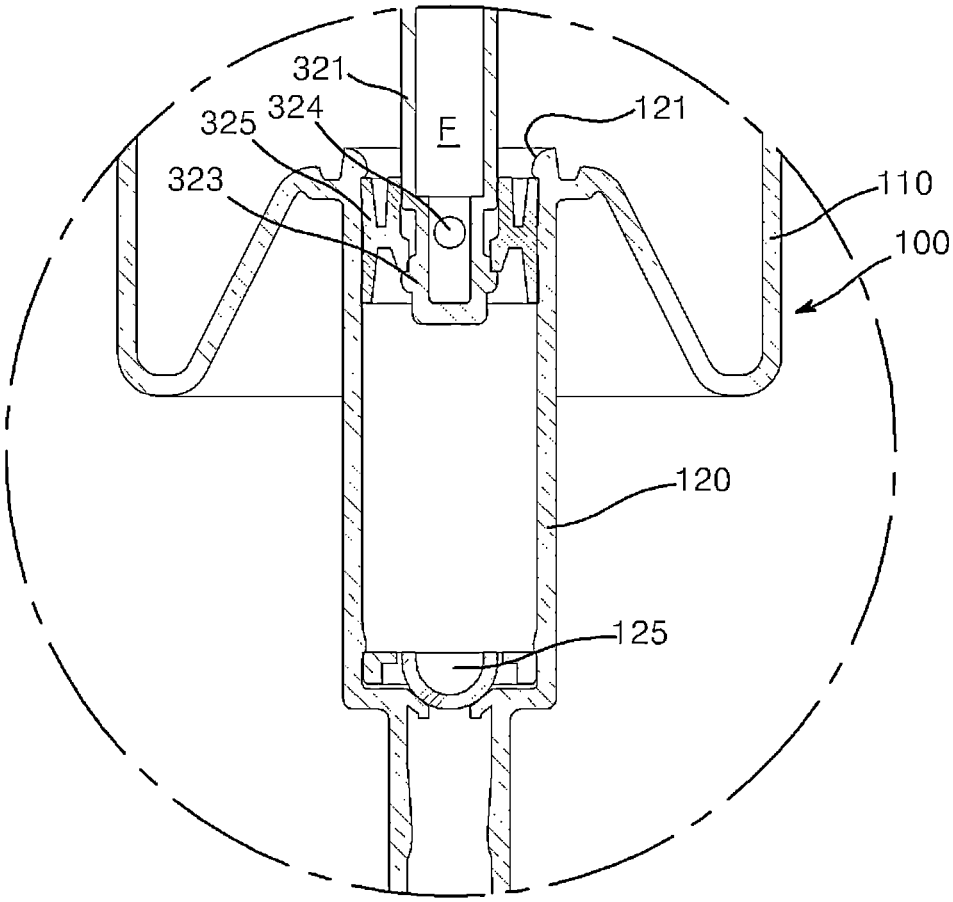
FIG. 3 is an enlarged view of a second open/close portion shown in FIG. 1.

FIG. 1 is a sectional view of a foaming pump according to one embodiment of the present invention, FIG. 2 is an enlarged view of a first open/close portion shown in FIG. 1, and FIG. 3 is an enlarged view of a second open/close portion shown in FIG. 1.

Referring to FIG. 1, a foaming pump 500 according to one embodiment includes a cylinder 100, a cover unit 200, and an open/close unit 300.

The cylinder 100 is a component to be inserted into a container 10 and receives contents discharged from the container 10 and air introduced from the outside. In this embodiment, the cylinder 100 includes a first cylinder 110 and a second cylinder 120.

The first cylinder 110 has a space (not shown) which receives air introduced from the outside. The first cylinder 110 is open at an upper side thereof, and the open upper side of the first cylinder 110 is sealed by an air piston 315 described below. The first cylinder 110 is coaxially coupled to an inner side of the cover unit 200.

The second cylinder 120 has a space (not shown) which receives the contents discharged from the container 10. The second cylinder 120 is formed at a lower side thereof with a cylinder inlet (not shown) through which the second cylinder 120 communicates with the container 10.

The cylinder inlet is provided with a valve 125 which opens or closes the cylinder inlet. In this embodiment, the valve 125 is injection-molded to have a plate shape. The valve 125 is deformed upwards to open the cylinder inlet by negative pressure applied to the valve 125 due to a vacuum created inside the second cylinder 120. When the valve 125 is open, the contents introduced through the cylinder inlet temporarily remain inside the second cylinder 120. The valve 125 may be formed of a material such as polyethylene through injection molding, thereby allowing easy manufacture, reducing manufacturing costs, and facilitating mounting to the second cylinder 120 through a single fitting operation.

In this embodiment, the first cylinder 110 and the second cylinder 120 are integrated into a single body. Thus, the second cylinder 120 concentrically extends downwards from a lower side of the first cylinder 110 and is coupled to the cover unit 200 through coupling between the first cylinder 110 and the cover unit 200.

The cover unit 200 is coupled to the container 10, and includes a first cover 210 and a second cover 220.

A head unit 400 is provided to the first cover 210 to be movable up or down, and the cylinder 100 is coupled to the inner side of the second cover 220. In this embodiment, the first cover 210 and the second cover 220 are integrated into a single body.

The second cover 220 includes an upper side covering the upper side of the first cylinder 110, and a lateral side extending downward from the upper portion of the second cover and surrounding an outer lateral side of the first cylinder 110. Further, the first cover 210 extends upwards from the second cover 220.

An inner side of the upper side of the second cover 220 is coupled to the open upper side of the first cylinder 110, and an inner side of the lateral side of the second cover 220 separated a predetermined distance from the lateral side of the first cylinder 110 is coupled to the container 10.

The open/close unit 300 opens or closes the cylinder 100, and includes a first open/close portion 310 and a second open/close portion 320. The first open/close portion 310 opens or closes the first cylinder 110. The first open/close portion 310 includes a first shaft 311 and an air piston 315.

Referring to FIGS. 1 and 2, the first shaft 311 is inserted into the head unit 400 so as to form a first air passage (a) between the first shaft 311 and the head unit 400. The first shaft 311 is provided therein with a flow path F through which the head unit 400 communicates with the second cylinder 120.

In addition, a first air inlet 312 through which the first air passage (a) communicates with the flow path F is formed at a side of the first shaft 311 adjacent the first air passage (a). The first shaft 311 is formed coaxial to a moving direction of the head unit 400 and thus moved up or down in association with the head unit 400.

The foaming pump 500 according to this embodiment further includes the head unit 400, which is movable up or down and operates the open/close unit 300. The head unit 400 includes a discharge portion 410, a head cover 420, and a press portion 430.

The discharge portion 410 is placed above the first shaft 311 and coupled to the first shaft 311. The discharge portion 410 discharges the contents when pressed. The discharge portion 410 is formed with an outlet 411 communicating with the flow path F. The outlet 411 is exposed to the outside of the discharge portion 410 and provides a path through which the contents pumped out from the container 10 through the flow path F are discharged to the outside. In this embodiment, the discharge portion 410 is moved downwards to lower the first shaft 311 when pressed.

The head cover 420 is placed outside the cover unit 200, and more particularly, the first cover 210. The head cover 420 extends parallel to the extending direction of the first cover 210 and is separated a predetermined distance from a lateral side of the discharge portion 410 to define a space between the discharge portion 410 and the head unit 420 such that the first cover 210 can be inserted into the space. A gap between the head cover 420 and the first cover 210 defines a second air inlet 421 through which the first cover 210 communicates with the outside.

The press portion 430 is placed inside the cover unit 200 such that a second air passage (b) communicating with the second air inlet 421 is formed between the cover unit 200 and the press portion 430. In this embodiment, the press portion 430 extends downwards from the discharge portion 410 and is placed inside the first cover 210 such that an outer surface of the press portion 430 can be separated a predetermined distance from an inner surface of the first cover 210. Thus, the second air passage (b) is formed in a space between the press portion 430 and the first cover 210.

An inner side of the press portion 430 is coupled to an outer surface of the first shaft 311 so as to define the first air passage (a) between the press portion 430 and the first shaft 311. In this embodiment, a portion of the inner side of the press portion 430 has a stepped shape so as to be separated a predetermined distance from the outer surface of the first shaft 311.

With such a configuration, the first air passage (a) is formed in the space between the first shaft 311 and the press portion 430, and communicates with the first air inlet 312. Further, the press portion 430 is moved downwards in association with the downward movement of the discharge portion 410 and forces the air piston 315 to be moved down.

Referring to FIG. 2, the air piston 315 is placed inside the first cylinder 110 to be movable up or down and pumps air from the first cylinder 110 toward the first air passage (a). The air piston 315 includes a contact surface 315*a*, a press surface 315*b*, and a shaft coupling portion 315*c*.

The contact surface 315*a* forms a lateral side of the air piston 315 and closely contacts the inner side of the first cylinder 110 so as to move up or down. The press surface 315*b* forms an upper side of the air piston 315 to be pressed by the press portion 430. The press surface 315*b* is formed at an inner side thereof with an insertion hole (not shown) into which the first shaft 311 is inserted.

The shaft coupling portion 315*c* extends upwards from a periphery of the insertion hole formed on the press surface 315*b*, that is, in an upward moving direction of the press portion 430. The first shaft 311 is coupled to an inner side of the shaft coupling portion 315*c*, and an air entrance 316 is formed between the shaft coupling portion 315*c* and the first shaft 311 such that the first air passage (a) and the second air passage (b) communicate with the first cylinder 110 through the air entrance 316.

In this embodiment, the open/close unit 320 further includes a support flange 313. The support flange 313 is formed at the lower side the first shaft 311 inserted into the air piston 315 via the shaft coupling portion 315*c* and supports an inner surface of the lower side of the press surface 315*b*. The support flange 313 supports the press surface 315*b* in an upward direction such that the air piston 315 can move up in association with upward movement of the first shaft 311.

In this embodiment, the first open/close portion 310 includes a rib 317 and a sealing projection 431. The rib 317 protrudes parallel to the shaft coupling portion 315*c* such that a sealing groove 318 can be formed on the press surface 315*b* between the rib 317 and the shaft coupling portion 315*c*. Further, the sealing projection 431 protrudes from a lower surface of the press portion 430 facing the press surface 315*b* and engages with the sealing groove 318 when the press portion 430 is moved down, thereby shielding the space between the air entrance 316 and the second air passage (b).

Such a blocking structure constituted by engagement between the sealing groove 318 and the sealing projection 431 shields the space between the air entrance 316 and the second air passage (b) to inhibit air pumped in the first cylinder 110 from leaking out via the second air passage (b) when the foaming pump 500 operates to discharge the content, thereby enabling effective introduction of air into the flow path F via the first air passage.

The foaming pump 500 according to this embodiment further includes a connecting member 330 and a filtering member 340. The connecting member 330 is placed between the discharge portion 410 and the first shaft 311 and connects the flow path F to the outlet 411. The filtering member 340 is placed in the connecting member 330 to allow a mixture of air and the contents introduced into the connecting member 330 via the flow path F to be transformed into foam. The filtering member 340 includes a first filtering member 341 and a second filtering member 343.

The first filtering member 341 is provided in the form of a mesh at one side of the connecting member 330. In this embodiment, the first filtering member 341 is placed at a lower side of the connecting member 330 adjacent the first shaft 311. The first filtering member 341 and the connecting member 330 may be integrally formed with each other through injection molding.

The second filtering member 343 is provided in the form of a denser mesh than that of the first filtering member 341 at the other side of the connecting member 330. In this embodiment, the second filtering member 343 is provided to an upper side of the connecting member 330 adjacent the outlet 411 to be fitted into a gap between the connecting member 330 and the discharge portion 410. The second filtering member 343 may be detachably provided between the connecting member 330 and the discharge portion 410.

Further, the filtering member 340 may further include a third filtering member 345. The third filtering member 340 is provided in the form of a mesh placed in the outlet 411. The third filtering member 345 and the discharge portion 410 may be integrally formed with each other through injection molding.

In this embodiment, the contents introduced via the flow path F and air introduced via the first air inlet 312 are mixed at a point where the flow path F and the first air inlet 312 are connected, and the mixture of air and contents is transformed into foam by friction with the first filtering member 341 and is then introduced into the connecting member 330.

The mixture of air and contents transformed into foam further undergoes friction with the second and third filtering members 343, 345 while passing through the outlet 411, thereby forming more rich foam.

As needed, the second filtering member 343 is placed between the connecting member 330 and the discharge portion 410. When the second filtering member 343 is provided as above, the mixture of air and contents having undergone friction with the filtering member 340 can be transformed into more softly and minutely uniform foam while passing through the first filtering member 341 and the second filtering member 343 formed to have a denser mesh than that of the first filtering member 341.

Furthermore, the foaming pump 500 according to this embodiment may further include an elastic member 350. The elastic member 350 is placed outside the press portion 430 and provides elastic restoration for returning the head unit 400 from a pressed state to an original state. In this embodiment, the elastic member 350 is illustrated as a coil spring that has an upper side supported by a lower side of the discharge portion 410 and a lower side supported by a support projection (not shown) protruding from the inner side of the cover unit 200. The elastic member 350 is placed outside the flow path F and does not contact the content, thereby inhibiting corrosion due to the contents or contamination of the content.

Referring to FIGS. 1 and 3, the second open/close portion 320 opens or closes the second cylinder 120, and includes a second shaft 321, an inlet section 323, and a piston 325.

The second shaft 321 concentrically extends downwards from the first shaft 311. The second shaft 321 is formed therein with a flow path F which communicates with the flow path F defined in the first shaft 311.

In this embodiment, the first shaft 311, the support flange 313 and the second shaft 321 are integrated into a single body such that the support flange 313 is formed between the first shaft 311 and the second shaft 321. Thus, the first and second shafts 311, 321 integrated into a single body are moved up or down together with each other.

The inlet section 323 is formed at a lower side of the second shaft 321 to form an inlet 324 through which the second cylinder 120 communicates with the flow path F. On an outer periphery of the inlet section 323, a guide groove (not shown) is formed to restrict movement of the piston 325 described below.

The piston 325 is placed inside the second cylinder 120 and selectively opens or closes the inlet 324. The piston 325 is coupled to outer surfaces of the second shaft 321 and the inlet section 323 to be movable up or down, and selectively opens and closes the inlet 324 while moving up or down on the second shaft 321 in association with upward or downward movement of the second shaft 321.

Further, the second cylinder 120 is formed therein with a hook protrusion 121. The hook protrusion 121 protrudes from an upper side of the second cylinder 120 towards an inner side of the second cylinder 120. The hook protrusion 121 interferes with the piston 325 and restricts the upward movement of the piston 325, whereby the piston 325 can be inhibited from being separated from the second cylinder 120.

Figure 4:
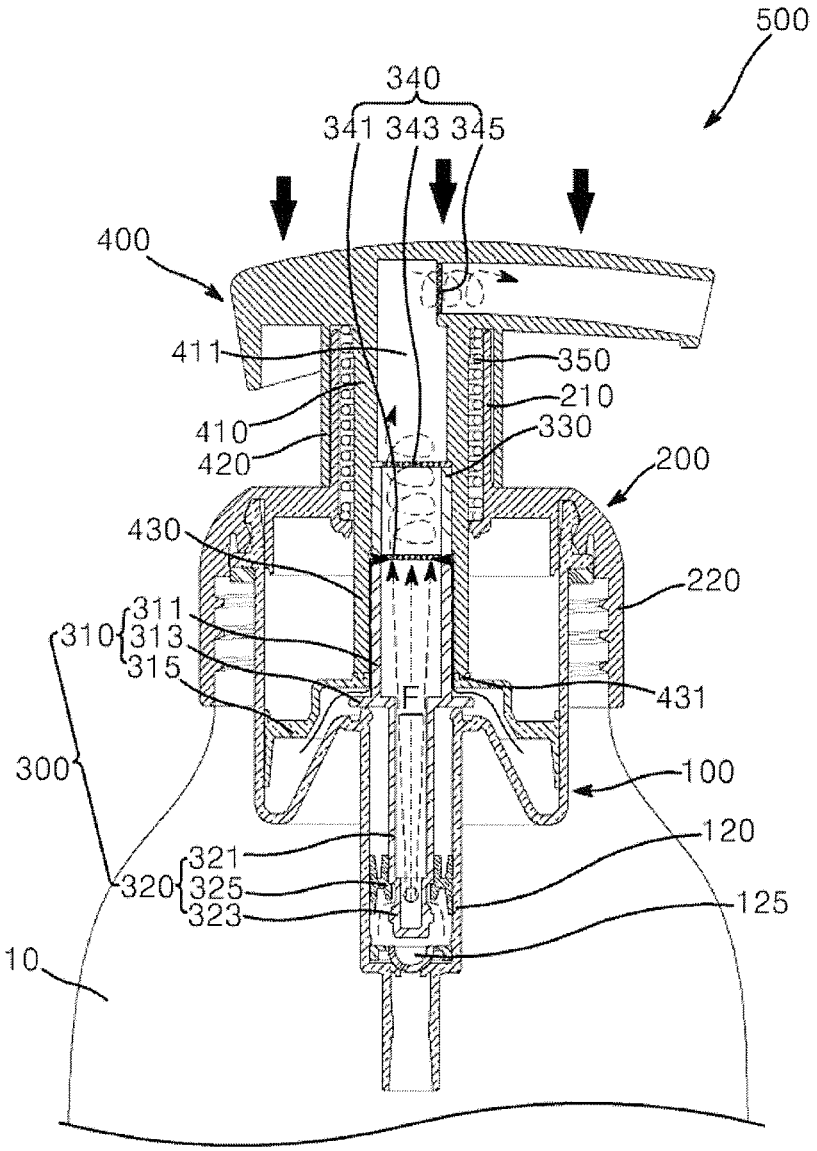
FIG. 4 is a view of the foaming pump according to the embodiment of the present invention in a content discharging state.
Figure 5:
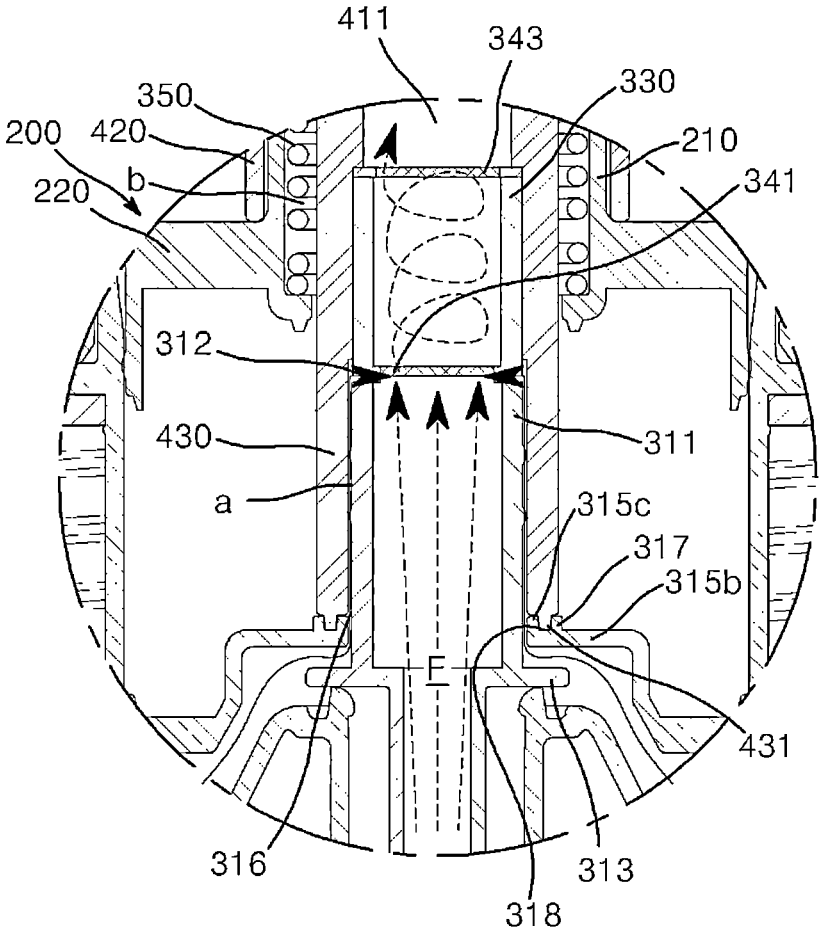
FIG. 5 is an enlarged view of the second open/close portion shown in FIG. 4.
Figure 6:
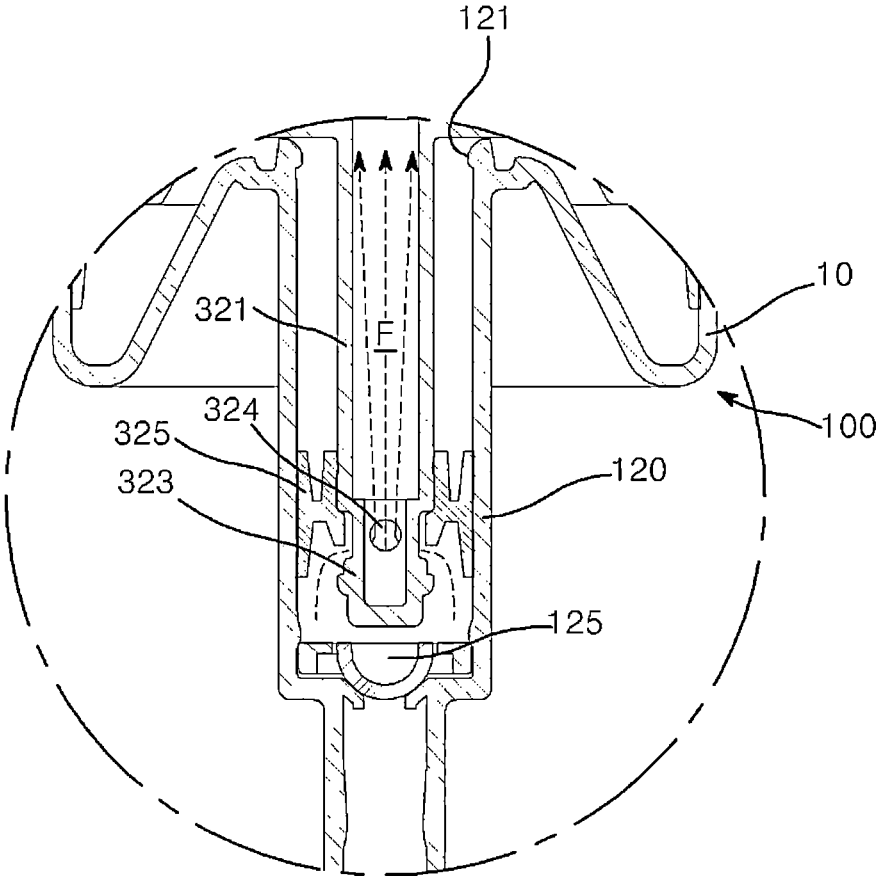
FIG. 6 is an enlarged view of the first open/close portion shown in FIG. 4.
Figure 7:
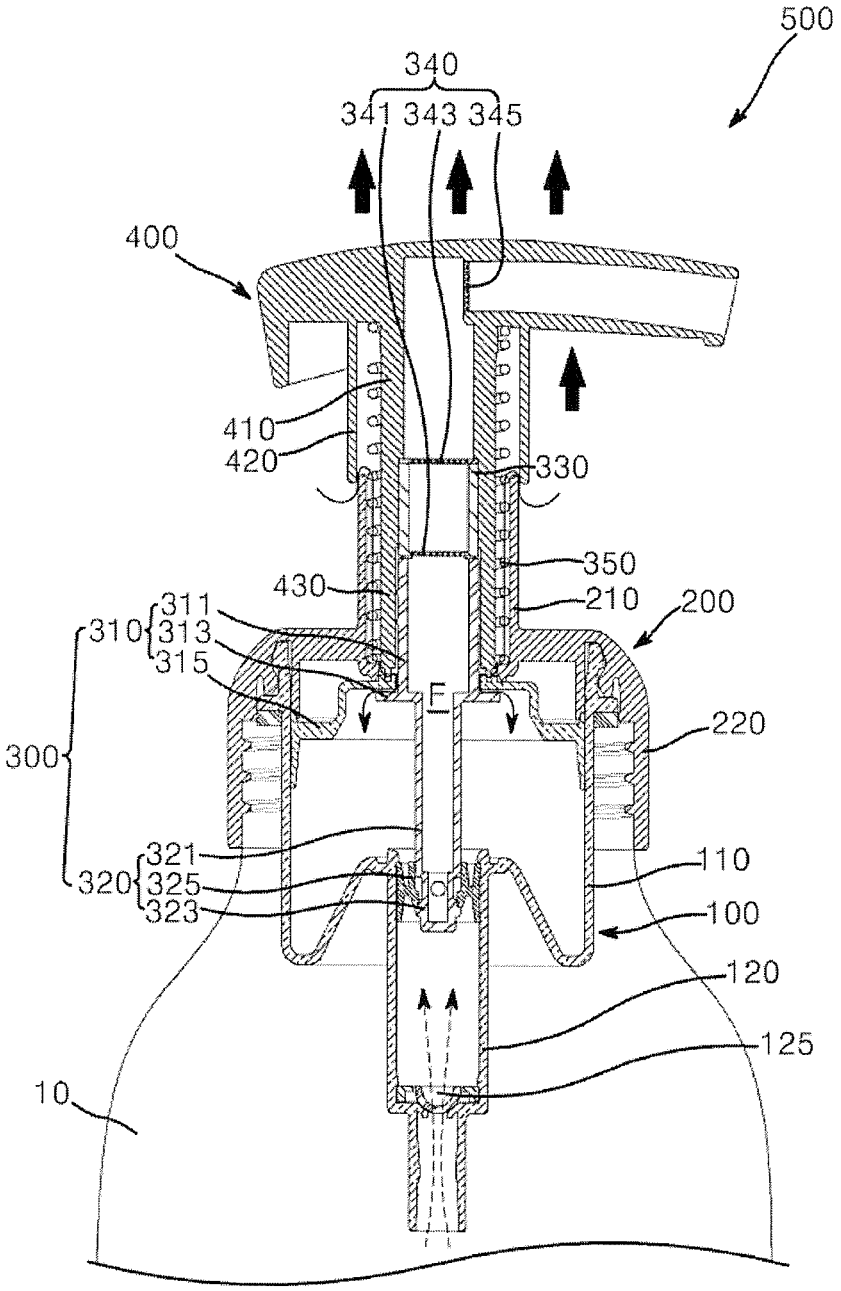
FIG. 7 is a view of the foaming pump according to the embodiment of the present invention in a returned state after discharging contents.
Figure 8:
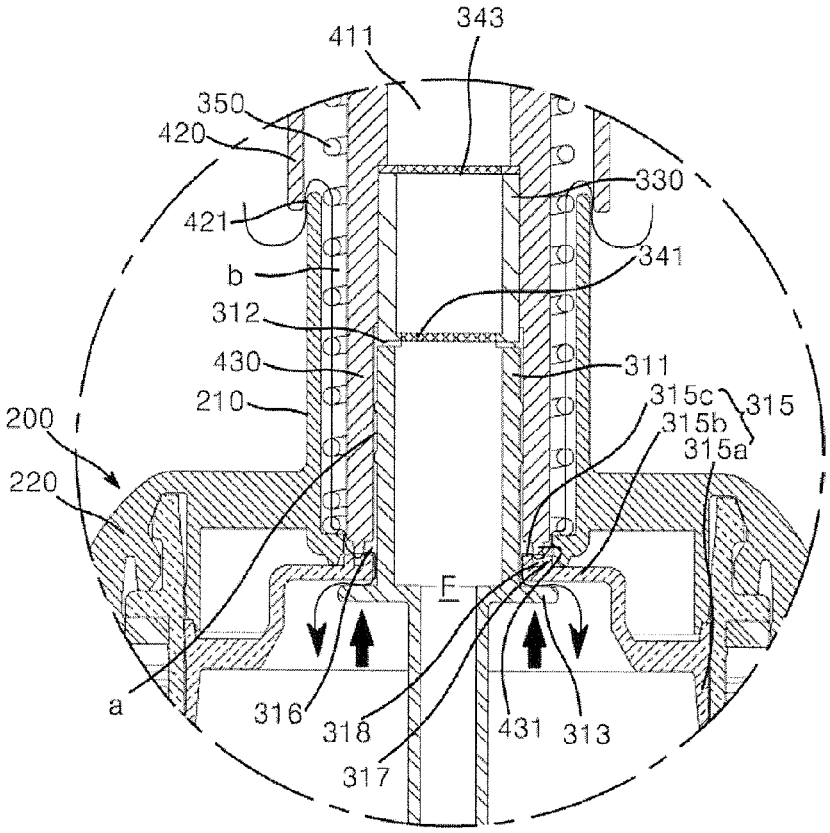
FIG. 8 is an enlarged view of the first open/close portion shown in FIG. 7.
Figure 9:
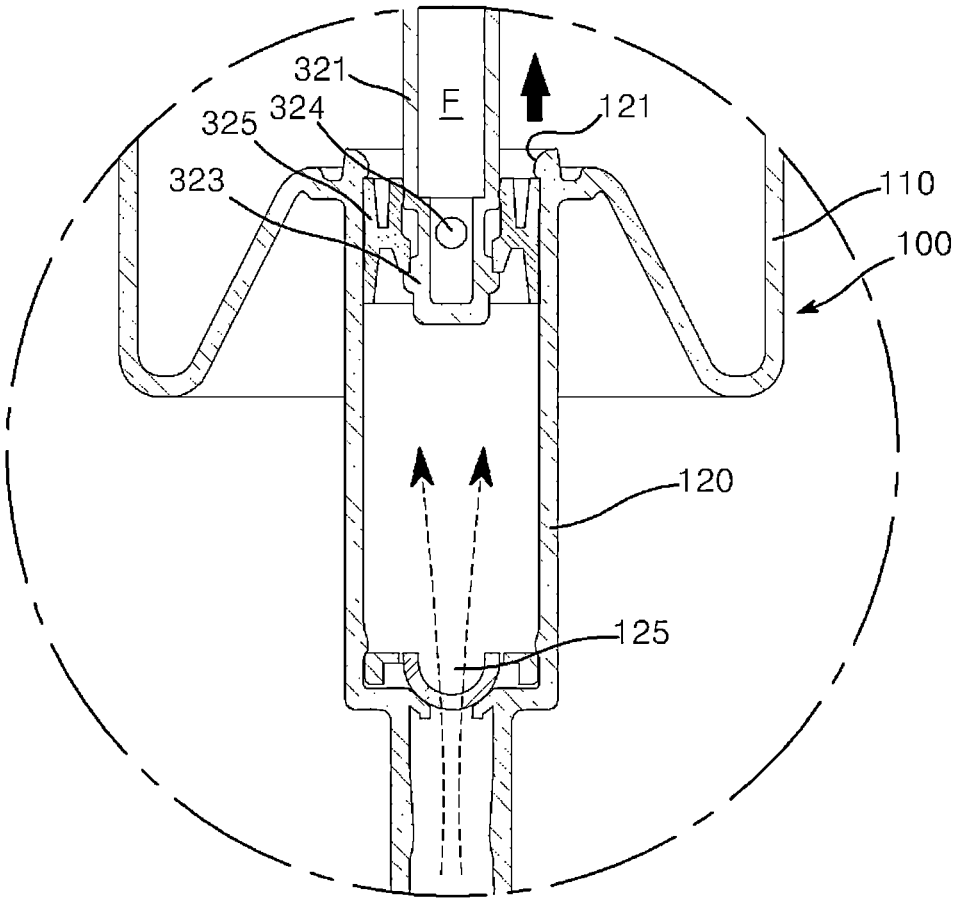
FIG. 9 is an enlarged view of the second open/close portion shown in FIG. 7.

FIG. 4 is a view of the foaming pump according to the embodiment of the present invention in a content discharging state; FIG. 5 is an enlarged view of the second open/close portion shown in FIG. 4; FIG. 6 is an enlarged view of the first open/close portion shown in FIG. 4; FIG. 7 is a view of the foaming pump according to the embodiment of the present invention in a returned state after discharging contents; FIG. 8 is an enlarged view of the first open/close portion shown in FIG. 7; and FIG. 9 is an enlarged view of the second open/close portion shown in FIG. 7.

Now, operation and effects of the foaming pump according to the embodiment of the present invention will be described with reference to FIGS. 4 to 9.

Referring to FIG. 4, when the head unit 400 is pressed by a user, the first shaft 311 and the second shaft 321 are moved downwards together with the head unit 400. Referring to FIGS. 4 and 5, the piston 325 provided to the second shaft 321 to be movable up or down is restricted due to friction between the second cylinder 120 and the piston 325, and opens the inlet 324 which has been closed. Here, the cylinder inlet (not shown) provided at the lower side of the second cylinder 120 is closed by pressure applied to the valve 125.

Thus, contents discharged from the container 10 and remaining in the second cylinder 120 are introduced into the second shaft 321 via the inlet 324, and then pass through the flow path F in the second shaft 321 and the first shaft 311. In this embodiment, the contents may include liquid detergents or cosmetics.

Referring to FIGS. 4 and 6, the air piston 315 placed inside the first cylinder 110 to be movable up or down is pressed downwards by the press portion 430 which is moved downwards due to downward movement of the head unit 400. When pressed, the air piston 315 pumps air from the first cylinder 110 toward the first air passage (a).

At this time, the sealing projection 431 protruding from the lower side of the press portion 430 engages with the sealing groove 318 when the press portion 430 is moved downwards and presses the press surface 315*b* of the air piston 315, and blocks the gap between the air entrance 316 and the second air passage (b).

Thus, the air pumped from the first cylinder 110 does not leak out and is fully introduced into the first air passage (a) by the blocking structure in which the passage connected to the second air passage (b) is blocked by engagement between the sealing groove 318 and the sealing projection 431.

The air pumped as above is introduced into the first air passage (a) via the air entrance 31, flows into the flow path F through the first air inlet 312, and is then mixed with the contents having passed through the flow path F. The mixture of air and contents is transformed into foam due to friction with the filtering member 340 and introduced into the connecting member 330.

The mixture of air and contents having undergone friction with the filtering member 340 can be transformed into more soft and minutely uniform foam while passing through the first filtering member 341 and the second filtering member 343 provided in the form of a denser mesh than that of the first filtering member 341, and transformed into rich foam while passing through the third filtering member 345. Finally, the foam is discharged to the outside via the outlet 411, as shown in FIG. 4.

When a user releases the head unit 400, elastic restoration provided by the elastic member 350 forces the first and second shafts 311 to return to an original state together with the head unit 400, i.e., the state before being pressed, as shown in FIG. 7.

Referring to FIGS. 7 and 8, operation of the second open/close portion 320 is illustrated. As the second shaft 321 is moved downwards, movement of the piston 325 is restricted due to friction between the second cylinder 120 and the piston 325, and the inlet 324 is closed again.

Here, the cylinder inlet (not shown) formed at the lower side of the second cylinder 120 is opened by negative pressure applied to the valve 125, whereby the contents received in the container 10 are introduced into the second cylinder 120 via the cylinder inlet.

Referring to FIGS. 7 and 9, operation of the first open/close portion 310 is illustrated. As the first shaft 311 is moved upwards, the air piston 315 is supported upward by the support flange 313 and moved upwards together with the first shaft 311.

Such movement of the air piston 315 creates a vacuum in the first cylinder 110, thereby allowing external air to be introduced into the first cylinder 110. As such, the vacuum created in the first cylinder 110 causes the external air to be introduced into the second air passage (b) via the second air inlet 421.

The space between the air entrance 316 and the second air passage (b), which has been blocked by the engagement between the sealing groove 318 and the sealing projection 431, is opened by upward movement of the press portion 430 to release the engagement between the sealing groove 318 and the sealing projection 431, whereby air introduced into the second air passage (b) can flow into the first cylinder 110 via the air entrance 316.

As such, the foaming pump 500 according to this embodiment includes the filtering member 340, which includes the first filtering member 341 and the second filtering member 343 having a denser mesh than the first filtering member 341, and the third filtering member 345 forming rich foam by generating friction again with foam formed by the first and second filtering members 341, 343, thereby generating soft, minutely uniform and rich foam.

In addition, the foaming pump 500 according to this embodiment provides a blocking structure between the air entrance 316 and the second air passage (b) through engagement between the sealing groove 318 and the sealing projection 431, and is more effective in introducing air to be mixed with contents therein, thereby generating rich foam through a single operation.

Further, in the foaming pump 500 according to this embodiment, the elastic member 350 is placed outside the flow path F so as not to contact the contents, and thus is protected from corrosion cause by the contents, or can inhibit the contents from being contaminated.

Although some embodiments have been provided to illustrate the present invention, it should be understood that these embodiments are given by way of illustration only, and that various modifications, variations, and alterations can be made without departing from the spirit and scope of the present invention. The scope of the present invention should be limited only by the accompanying claims and equivalents thereof.

What is claimed is:

1. A foaming pump comprising a cylinder which receives contents discharged from a container and air introduced from outside;

an open/close unit which opens or closes the cylinder;

a head unit movable up or down and operating the open/close unit; and a cover unit coupled to the cylinder and the head unit to allow the head unit to move up or down therein;

wherein the cylinder comprises a first cylinder receiving air introduced from the outside and a second cylinder receiving the contents discharged from the container;

wherein the open/close unit comprises a first open/close portion opening or closing the first cylinder and a second open/close portion opening or closing the second cylinder, wherein the first open/close portion comprises:

a first shaft inserted into the head unit to form a first air passage between the head unit and the first shaft, the first shaft being formed therein with a flow path through which the head unit communicates with the second cylinder, and a first air inlet through which the first air passage communicates with the flow path; and an air piston movable up or down inside the first cylinder and pumping the air from the first cylinder toward the first air passage;

wherein the head unit comprises:

a discharge portion formed therein with an outlet communicating with the flow path, the discharge portion being moved downwards by pressing operation to move the first shaft downwards;

a head cover placed outside the cover unit to form a second air inlet between the head cover and the cover unit; and a press portion placed inside the cover unit to form a second air passage communicating with the second air inlet between the cover unit and the press portion, the press portion being coupled to an outside of the first shaft to form the first air passage between the first shaft and the press portion, and being moved downwards in association with downward movement of the discharge portion to move the air piston downwards; and wherein the air piston comprises:

a press surface forming a top surface of the air piston; and a shaft coupling portion to which the first shaft is internally coupled to form an air entrance through which the first air passage and the second air passage communicate with the first cylinder between the first shaft and the shaft coupling portion.

2. The foaming pump according to claim 1, further comprising:

a connecting member placed between the discharge portion and the first shaft and connecting the flow path to the outlet; and a filtering member disposed in the connecting member to allow a mixture of contents and air introduced into the connecting member to be transformed into foam, the filtering member comprising a first filtering member formed with a mesh and provided to one side of the connecting member, a second filtering member formed with a denser mesh than the first filtering member and provided to the other side of the connecting member, and a third filtering member formed with a mesh and provided to the outlet.

3. The foaming pump according to claim 1, further comprising an elastic member placed outside the press portion and providing elastic restoration to return the head unit from a pressed state to an original state.

4. The foaming pump according to claim 1, wherein the open/close unit further comprises a support flange supporting the press surface in an upward direction to allow the air piston to move upwards in association with upward movement of the first shaft.

5. The foaming pump according to claim 4, wherein the second open/close portion comprises:

a second shaft formed therein with the flow path;

an inlet section formed at a lower side of the second shaft to form an inlet through which the second cylinder communicates with the flow path; and a piston disposed in the second cylinder to selectively open or close the inlet.

6. The foaming pump according to claim 5, wherein the support flange is placed between the first shaft and the second shaft, and the first shaft, the support flange and the second shaft are integrated into a single body to be movable up or down.

* * * * *